United States Patent [19]

Tournier et al.

[11] Patent Number: 4,511,433

[45] Date of Patent: Apr. 16, 1985

[54] METHOD FOR THE SIMULTANEOUS DELIGNIFICATION OF WOOD AND OTHER LIGNO-CELLULOSIC MATERIALS AND HYDROLYSIS OF THE HEMICELLULOSE COMPONENT THEREOF

[75] Inventors: Herve Tournier, Valleiry, France; Allan A. Johansson, Meyrin, Switzerland; Jean-Pierre Sachetto, Saint Julien En Genevois, France; Jean-Michel Armanet, Onex, Switzerland; Jean-Pierre Michel, Collonges Sous Salve; Alain Roman, Bossey, both of France

[73] Assignee: Battelle Memorial Institute, Carouge, Switzerland

[21] Appl. No.: 636,061

[22] Filed: Jul. 27, 1984

Related U.S. Application Data

[63] Continuation of Ser. No. 329,360, Dec. 10, 1981, abandoned, which is a continuation-in-part of Ser. No. 274,350, Jun. 17, 1981, abandoned.

[30] Foreign Application Priority Data

Jun. 20, 1980 [CH] Switzerland ..... 4737/80

[51] Int. Cl.[3] ..... C13K 1/02; D21C 3/02; D21C 3/20; D21C 11/00

[52] U.S. Cl. ..... 162/16; 127/37; 162/30.1; 162/72; 162/76; 162/77

[58] Field of Search ..... 162/16, 72, 76, 77, 162/30.1, 71; 127/36, 37; 260/124 R

[56] References Cited

U.S. PATENT DOCUMENTS

| | | | |
|---|---|---|---|
| 2,024,689 | 12/1935 | Groombridge | 162/77 |
| 3,522,230 | 7/1970 | Buckart et al. | 162/76 |
| 3,776,897 | 12/1973 | Ikari et al. . | |

FOREIGN PATENT DOCUMENTS

| | | |
|---|---|---|
| 326059 | 9/1920 | Fed. Rep. of Germany . |
| 328783 | 11/1920 | Fed. Rep. of Germany . |
| 2229673 | 1/1977 | Fed. Rep. of Germany . |
| 1430458 | 1/1966 | France . |
| 341861 | 1/1931 | United Kingdom . |
| 2036826A | 7/1980 | United Kingdom . |

OTHER PUBLICATIONS

Wright et al. "Studies of Lignin and Related Compounds," Jan. 1937, pp. 125–130.

W. H. M. Schweers, "Phenol Pulping", Chemtech, Aug. 1974, pp. 491–494.

Vorher and Schweers, "Utilization of Phenol Lignin", Appl. Polymer Symposium No. 28, pp. 277–284 (1975).

Wayman and Lora, "Aspen Autohydrolysis", TAPPI/-Jun. 1978, vol. 61, No. 6, pp. 55–57.

April, Kamal, Reddy, Bowers and Hansen, "Delignification with Aqueous-Organic Solvents", TAPPI/May 1979, vol. 62, No. 5, pp. 83–85.

Zoch, Harris and Springer, "Furfural from Spent Sodium-Base Acid Sulfite Pulping Liquor", TAPPI/Mar. 1969, vol. 52, No. 3, pp. 486–488.

*Primary Examiner*—Steve Alvo

*Attorney, Agent, or Firm*—Kenneth R. Warburton

[57] ABSTRACT

A method for delignifying ligno-cellulosic materials and efficiently separate from each other the constituents thereof. Said materials are heated in an aqueous acid medium in the presence of phenol compounds. Then the reaction medium is drained and washed for isolating the purified solid cellulose pulp, the liquid phase separating into two layers: an aqueous layer rich with pentoses and an organic layer rich with phenols and lignin, the latter providing, by distillation and pyrolysis of the residue, a quantity of phenols at least equal to that of the phenols used in the delignification stage.

16 Claims, 1 Drawing Figure

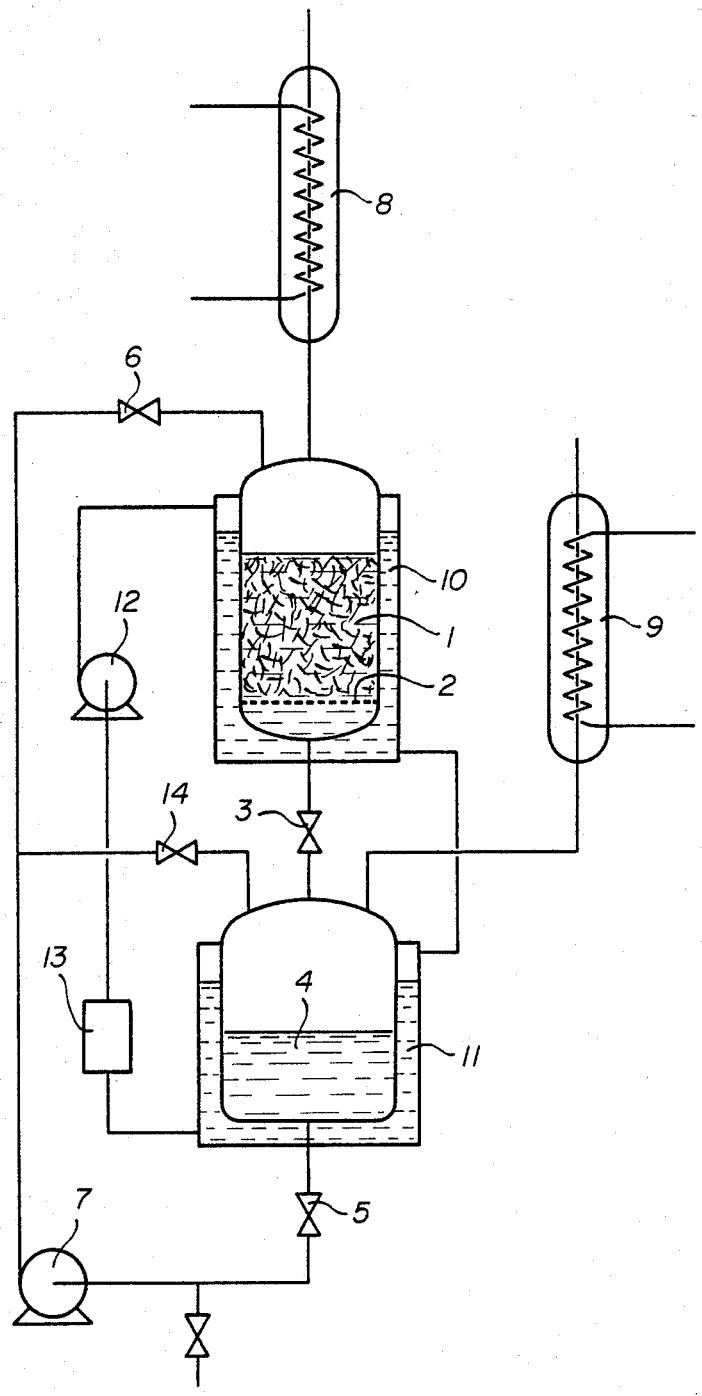
8
6
10
12
1
9
2
14
3
13
4
11
7
5

METHOD FOR THE SIMULTANEOUS DELIGNIFICATION OF WOOD AND OTHER LIGNO-CELLULOSIC MATERIALS AND HYDROLYSIS OF THE HEMICELLULOSE COMPONENT THEREOF

This application is a continuation of application Ser. No. 06/329,360 filed Dec. 10, 1981 now abandoned, which was a continuation-in-part of application Ser. No. 06/274,350, filed June 17, 1981, and now abandoned.

FIELD OF THE INVENTION

The present invention concerns a method for the simultaneous delignification of wood and other lignocellulosic materials and hydrolysis of the hemicellulose component thereof into monomeric sugars in the presence of aqueous acid, phenol or mixtures of phenols or other phenolic materials. The invention also concerns the development of the chemistry of wood constituents in general and, particularly, the efficient separation from each other and recovery of cellulose pulp, the pentoses derived from wood and, finally, the phenols issued from lignin.

BACK-GROUND OF THE INVENTION

It is already known to use phenol and other similar compounds with phenolic functions for removing lignin from wood and thus obtaining a cellulose pure enough for the manufacture of paper, for instance. Thus, in this connection, SCHWEERS (Chemtech. 1974, 491; Applied Polymer Symposium 28, 277 (1975)) discloses the use, for one part of sawdust, of 4 parts of phenol with 10% of water acidified with 0.05% of HCl or 2% of oxalic acid and to heat the mixture for 3 hrs at 160° C.-170° C. in an autoclave. Under such conditions, and after separating the liquid phase, he reports to obtain cellulose yields of the order of 40 to 60% relative to the weight of the wood treated, such cellulose having a K (Kappa) index of the order of 40 to 100. The K index, used in the paper industry for defining the quality of the delignified cellulose, refers, among other things, to the lignin content of cellulose after delignification; this content is approximately equal to $K \times 0.15$ (TAPPI T—236 m—60, 1960). In this method, there can be also used, instead of phenol, the pyrolysis products of "phenol-lignin", the product which forms from phenol and lignin during the delignification of wood with phenol (German Pat. Appl. DOS No. 2.229.673). Normally, this phenol-lignin, which is found to be mixed with the starting phenol at the end of the delignification operation, is separated from the delignified cellulose by draining on a filter and washing with an organic solvent after the delignification operation is terminated.

In addition, other phenolic products, such as the various xylenols, catechol, resorcinol, hydroquinone, the naphthols and naphthalenediols have been used for delignifying wood using concentrations of about 2% by weight relative to the latter and heating (in aqueous medium, using a 1/1 wood to water suspension) for 90 min at 175° C., and thereafter extracting with a dioxane-water mixture (WAYMAN & LORA, TAPPI 61 (6), 55 (1978)). In these conditions, yields of cellulose of the order of 60%, with a residual lignin content of 4.6% (use of $\beta$-naphthol), have been reported.

Further, APRIL et al (TAPPI 62 (5), 83 (1979)) reported the heating to 205° C. of pinewood sawdust in the presence of 15 parts of a 1:1 mixture of phenol and water, such a treatment providing a cellulose with no more than 3% of lignin. From this reference, yields in purified cellulose are of the order of 40%.

The methods of the prior-art described above are undoubtedly of technical interest since they permit avoiding classical delignification conditions (Kraft, Sulfite process, etc . . . ) which require the use of sulfur compounds that can be recycled only with difficulty and which lead to hard pollution problems. However, these methods of the prior-art have some drawbacks, especially regarding the need of having to work at temperatures above 100° C. and under pressure. Thus, such conditions may raise problems related to using pressure resisting and leakproof reactors. Also, since the hemicellulose component of the vegetal material may undergo hydrolysis into pentoses during the delignification operation, the decomposition of said pentoses into furfural may become significant at the high temperatures involved and resinification of the latter will occur. Also, the reaction between phenol and the lignin resulting from delignification to phenol-lignin is emphasized as well as the reaction of said phenol-lignin with the products issued from the decomposition of the pentoses, all this leading to hard resins; thus, recovery and recycling of the phenol solvents put into work will become difficult or even impossible.

The use of aqueous phenol in the presence of acid catalysts for effecting the delignification of wood and other vegetal materials is mentioned in old references dating 1919 (German Patents Nos DE-326 705and 329 783, HARTMUTH). It is said in these references that catalysts which are convenient include certain mineral and organic acids and other compounds providing acids under operational conditions such as $AlCl_3$, $CuCl_2$, $SnCl_4$, $TiCl_3$, nitrophenol, chlorophenol, etc. The quantities of these catalysts are given to be "more or less" in reference No. 328 783 without any further specification, whereas in reference No. 326 705, there is indication that the catalyst consists of a 0.01% HCl solution.

There is also a reference (U.K. patent application No. 2,036,826 A) which discloses the simultaneous delignification and conversion into sugars of lignocellulosic materials by an acid-catalyzed reation in the presence of organic solvents. However, this method involves using high temperatures and pressure and it thus requires high investment in equipment.

The existence of other references of which the subject matter is somewhat related to the present invention also can be included as general background to the art. U.S. Pat. No. 3,776,897 concerns the addition to a previously acidified sulfite liquor for the delignification of wood of an organic solvent that will first cause hemicellulose to separate followed by the separation of an aqueous phase containing dissolved sugars and an organic phase containing lignin. There are possible some analogies between the operations involved in this separation process and the practical undertaking of the present invention. However, in the chemical industry, the selective extraction of components by causing a solution to separate into two non-miscible liquid phases is well known per se and, with regard to any relevancy to the present invention, the reference discloses no more than a practical text-book on experimental chemistry. The general field of this reference, i.e. the alkaline sulfite liquor to be acidified and the practically negligible hydrolysis extent of the pentosanes, etc . . . , also does not appear to be particularly relevant.

Another reference, French Pat. No. 1.430.458 provides a disclosure very similar to that of the above U.S. Patent. Moreover, a third reference, GB Pat. No. 341.861, concerns the distillation at 300° C. of the residues resulting from the evaporation of the alkaline digestion solutions of ligno-cellulosic materials. Such residues, rich with pentosanes and lean of lignin (see page 1, lines 60–85) provide by distillation mixtures of acids, hydrocarbons, phenols, furfural and various gases, which result does not seem much different from that of simply distilling wood (except for methanol). Finally, a last reference (TAPPI 52, 486–488 (1969)) concerns the conversion into furfural of the residual pentoses from a sulfite liquor for the delignification of wood.

Thus, one object of the present invention is to provide a simple and economical route to the efficient separation in high yields of the constituents of wood or of other ligno-cellulosic materials, e.g. straw, chaff, bark residues, dry leaves and other vegetal refuses.

Another objective of the invention is to provide a method for delignifying the above mentioned ligno-cellulosic materials and furnishing a delignified cellulose pulp of excellent grade and purity to the dissolving pulp industry or a feedstock for the production of glucose which is much more easily and efficiently processed than the initial cellulose of the ligno-cellulosic materials.

Still another object of the invention is to provide the industry with phenols extracted in high yields from wood or other ligno-cellulosic materials as well as the pentoses that can be further processed to valuable fuels, chemicals and synthetic resins.

Still another object of the invention is to provide an efficient way to recover valuable products from wooden scrap or other vegetal refuses which are normally burned in the fields or disposed of in streams or sewers, thus acting as strong pollutants of the environment.

Other objects of the invention will become evident from the description given hereinafter.

SUMMARY OF THE INVENTION

The method of the invention meets the above-mentioned objects, remedies the drawbacks of the prior-art and provides, in addition, other unexpected and surprising advantages as will be seen later. It comprises heating one part by weight of the ligno-cellulosic material with at least 0.5 part by weight of diluted aqueous acid, the pH of which is below 1.5, and at least 0.4 parts by weight of phenol or of one or several other phenolic compounds. Phenolic compounds include the compounds mentioned hereinabove and others to be defined hereinafter. Heating involves temperatures in the range of the reflux temperatures of the water and phenols mixture under ambient pressure or slightly above or below ambient pressure, i.e. from, say, about 90° to 110° C. The weight of the ligno-cellulosic material referred to above should be understood as calculated on a dry basis, i.e. after substracting the natural moisture contained in the material. Sufficient agitation or displacement of the liquid around the solid is preferably provided to ensure mutual contact of the reactants. A continuous leaching of the solid material by the liquid in order to procure efficient conditions for the dissolving of the lignin component thereof and the hydrolysis of the hemicellulose is advantageous when using relatively high liquid to solid ratios. In such case, efficient contact is provided by refluxing the suspension of solids in the liquid at the boiling temperature under ambient or slightly lowered or raised pressure. However, depending on the nature and the structure of the ligno-cellulosic material, when using low liquid solid ratios, i.e. in the range of about 0.5 to about 2 or even 4 parts of aqueous acid or aqueous acid plus dissolved phenol for 1 part of dry ligno-cellulosic material (or of ligno-cellulosic material plus undissolved phenol), initial milling or kneading of the comminuted solid with the liquid (the aqueous acid plus the dissolved phenol) before heating is sufficient for ensuring proper contact between the solid and the liquid reactants. Alternatively to providing liquid motion by simple boiling, the latter can be continuously brought into contact with the solid in divided form and removed therefrom, for instance by circulating it in a closed circuit with a pump. Since, as said above, the reflux temperature of such liquid mixture is around 100° C. at ambient pressure (or slightly above or below said pressure), it is not necessary to provide a gas tight or pressure resistant autoclave which is an important economical factor.

The kind of aqueous acid used is not critical as long as it is a strong acid. Thus, mineral acids such as $H_2SO_4$, HCl, $H_3PO_4$ and the like are suitable but hydrochloric acid and sulfuric acid are preferred. One can also use strong organic acids if desired such as, for instance, oxalic, benzene-sulfonic and other aromatic sulfonic acids, trichloroacetic acid, etc. i.e. in general, good water-soluble acids with a pK below 2. Preferably, one uses HCl with a concentration of between 0.5 and 5%, preferably 1 to 3% by weight. If sulfuric acid is used, concentrations in the range of 3 to 6% by weight in water are preferably used.

It should be noted at this stage that the use of aqueous phenol in the presence of acid catalysts for effecting the delignification of wood and other vegetal materials is mentioned in the previously referred to 1919 German Patents of HARTMUTH. Yet, even in view of these German Patents teachings, the present inventors have established that with such a diluted acid solution (pH above 2) as a catalyst, it was not possible (at 100° C. under ordinary pressure) to correctly delignify ligno-cellulosic materials as will be seen later in the experimental part of the present disclosure. Moreover, it is never indicated in the above references that by operating under the directions given therein it was possible to effect a substantially complete hydrolysis of the hemi-cellulose component and to separate, from the delignified cellulose, on one hand the sugars from hydrolysis of the hemi-cellulose fraction of the starting material and, on another hand, the phenols arising from the decomposition of the lignin. Indeed, the references rather report that, after recovery of the initial phenol reactant by distillation of the liquid phase, there remains a residue that will turn out into a hard resin. This disclosure is therefore strong evidence that furfural has formed and has reacted with the lignin decomposition products, the avoiding of such detrimental factor being precisely one of the objects of the present invention. Thus, in contrast, in the invention, the desired separation of the components can be achieved under excellent conditions as will be seen hereinafter.

It should be also mentioned that, an HCl concentration significantly less than 0.5% by weight is not useful at reflux temperature and ordinary pressure, and, in the present invention, HCl concentrations significantly above 5% by weight in the water phase are either use-less or even harmful; thus, for instance, if the reaction is performed with more concentrated acid, say, about 10% HCl, undesirable reactions may happen such as partial decomposition of the products with resinification and yield losses. Evidently, such conditions will be avoided in general except in cases where special effects are wanted. With acids other than HCl, higher concentrations in proportion to higher molecular weights of such acids are possible. For instance with $H_3PO_4$, concentrations of up to 10% are still admissible.

BRIEF DESCRIPTION OF THE DRAWING

The drawing presents schematically a piece of equipment useful for practicing the invention,

DETAILED DESCRIPTION OF THE DRAWING

The annexed drawing illustrates schematically a small semi-works piece of equipment for carrying out the delignification of comminuted vegetal materials according to the invention.

The apparatus represented in the drawing comprises a reactor 1 filled with comminuted vegetal material down to a retaining filter screen 2 which retains the solid in the reactor but allows circulation of the delignification liquid. The bottom of reactor 1 is connected by a cock 3 to a tank 4 containing the supply of delignification solution. This solution is circulated from the bottom of tank 4, through valves 5 and 6, by a pump 7 to the upper part of reactor 1 wherefrom it penetrates the vegetal particles thus effecting a continuous leaching of said particles. Reactor 1 is further equipped with a reflux condenser 8 and tank 4 is also equipped with a reflux condenser 9. The apparatus further comprises two heating mantles 10 and 11 for the reactor and the tank, respectively, in which a heating liquid (oil or any heating fluid) is circulated by a pump 12 and heated in a thermostat controlled heater element 13. A by-pass valve 14 exists between pump 7 and valve 6 for ensuring easy control of the flow rate of the circulating delignification liquid in order that gentle boiling be maintained in reactor 1.

The operation of the equipment is self evident to skilled persons from the above description. The drawing and its illustrated apparatus would not appear to require further description here, although reference is made to Example 6, which follows, for greater details thereon and its operation in practice of the invention.

PREFERRED MODES OF CARRYING OUT THE INVENTION

As the phenol and other phenolic compounds, the following compounds can be used in the invention in addition to hydroxybenzene and most of the commercially available phenols: p-cresol and o-cresol (the cresols have the further advantage of being precipitable at the end of the reaction from the reaction mixture by adding $Ca^{++}$ ions), guaiacol, 4-ethylphenol, 2,4-xylenol, 4-methylguaiacol, 4-ethylguaiacol, 2-ethylguaiacol, 4-vinylguaiacol, 4-propylguaiacol, eugenol, 1,3-dimethoxypyrogallol, vanillin, 1,3-dimethoxy-5-methylpyrogallol, trans-isoeugenol, catechol, phloroglucinol, pyrocatechol, homocatechol, etc . . . and any mixtures of such phenols or, also, mixtures of the phenolic products generated by the pyrolysis of phenol-lignin, the latter being the product provided, as already mentioned before, by the reaction of phenol (or the other phenolic compounds) with the degraded and dissolved lignin produced in the course of the delignification of ligno-cellulosic materials in the presence of phenol (or the mixture of phenols). Furthermore, within the present method, the whole or part of the phenolic reagent material can consist of the phenol-lignin itself (provided it has not been too much degraded and converted into a resin by its reaction with the products from the thermal decomposition of the pentoses provided by the hydrolysis of hemicellulose, e.g. furfural). Yet, (and this is one of the unexpected advantages of the invention) at the relatively mode-rate temperatures used, the hydrolysis of the pentoses of wood in diluted acid in the presence of phenol takes place under optimal conditions with an exceptionally high yield and the pentoses thus provided only undergo a minimum of decomposition to furfural or other products. As a result, the level of resinification of the phenol-lignin is low and the latter can be reused several times, from cycle to cycle, without losing much of its delignification efficiency. This feature is a considerable advantage relative to the prior-art in which, because of the actually implemented temperatures of the order of 160° C. or more, phenol-lignin hardens rapidly and thus loses its desirable properties of being a delignification solvent. It should be understood that when phenol lignin is used in the present invention, it is preferably used in admixture with the aforesaid phenol or other phenolic compounds.

Besides, working under conditions preventing the decomposition of pentoses is another advantage since they can be recovered thereafter for further use as will be seen later in this disclosure.

Moreover, and this is one of the most significant and unexpected advantages of this invention, when a liquid to solid ratio of 4 to 1 or more is used, it is not necessary, after separating the purified cellulose by draining at the end of a reaction cycle, to distil the ligno-phenolic phase for recovering the phenol mixture to be reused in the delignification of a new lot of wooden material. It is enough to isolate by filtration, on one hand the solid delignified cellulose and, on the other hand, the combined aqueous and organic phase, the latter containing the still unreacted phenol and the phenol-lignin; this liquid combination is then directly reusable, after addition of a fresh portion of vegetal material, for the next delignification operation. This recycling can continue until the aqueous phase becomes highly loaded with pentoses (up to about 200 g/l). At this stage, it is evident that the aqueous solution must be put aside for recovering the dissolved pentoses; also, at this stage, the phenol-lignin phase mixed with the phenols must be set aside too, since it has lost part of its efficiency as a delignification solvent because of overconcentration and contamination with the degradation and polymerization products derived from the pentoses. However, and here is still another advantage of the invention, this ligno-phenolic phase can then provide, by distillation and pyrolysis, an excellent yield of wood-phenols (a mixture that is suitable for carrying out the present process) which makes the invention self-independent from outside phenol supplies and even produces an excess of phenol and other phenolic compounds.

The invention enables thus to produce, under exceptionally economical conditions and with excellent yields, a cellulose of high degree of purity (even from ligno-cellulosic products with a high percent of lignin), pentoses that can be easily separated and are usable for various purposes, and phenols part of which is naturally recycled in the process and an excess that can be processed according to usual means (distillation, extraction, etc . . . ) for separating the various components thereof for future use.

In the method of the present invention, the amount of acidified water used relative to the milled or comminuted ligno-cellulosic materials (wooden chips or dust, chopped straw from grain crops, rice and various cereals, husked corn cobs and, in general, all green or dry ligno-cellulosic materials) is not particularly critical provided that efficient contact of said aqueous acid and the ligno-cellulose to be delignified is provided and that the amount of water required to hydrolyze the hemicellulose is stoichiometrically sufficient. Thus, in case the liquid to solid ratio is rather high, i.e. about 2 to 1 or more, an efficient mixing action leading to a good contact, continuously renewed, between the solid to be delignified and the delignification solution can be provided by the refluxing agitation or the percolating effect at the acid water phenol boiling temperature. To enable easy agitation or refluxing, it is enough to have about 2 to 4 parts by weight or more of aqueous liquid for one part by weight of the suspended solid, but operating with more liquid is possible if desired, for instance with 5 to 50 parts of liquid; however, to use very large volumes of liquid may cause problems related to the large size of the equipment needed for handling. It should be remembered also that a good contact between the solid and the liquid can be ensured by agitation of the latter with an agitator or by circulating it continuously by means of a pump through a bed of the comminuted solid material. If the liquid to solid ratio is rather low, i.e. below about 2 or 3 to 1, it is usually sufficient to mix the aqueous acid plus phenols and the comminuted vegetal material by kneading for instance with a paddle kneader or, more simply, by simultaneously admitting the solid and the liquids into a heated tubular reactor by means of a screw and slowly conveying the mixed solid and liquids along the heated area of said reactor. Then the solid-liquid mixture will progressively react, contract in size and aquire sufficient fluidity to be extracted at bottom of the reactor by other conveying means.

Regarding now the quantity of phenol or phenols required for the delignification operation, again this is not critical provided there is used enough thereof for ensuring a good delignification of the wood. Thus, if 4 parts of phenol or of the mixture of phenols are in general sufficient for 10 parts of comminuted ligno-cellulosic materials, one can use more phenol if desired, i.e. 10, 20 or even 50 parts of phenol for 10 parts of ligno-cellulosic material. To use much phenol and much aqueous phase relative to the dry comminuted solid may seem at first to be attractive because, in case recycling is contemplated, exaustion of the liquid reagents will be slower and it will be possible to recycle the liquid phase a greater number of times before having to set it aside for the extraction of useful pentoses and phenols therefrom. However, such technique has the disadvantage that, if the ratio of the solid material to the total volume of the reaction medium is very small, the yield in each cycle is also small and the overall yield based on the total amount of reactants used after a number of cycles will not be practically modified.

In the general practice of the invention, there will preferably be used for one part of comminuted ligno-cellulosic materials 1 to 6 parts by weight of phenol and 1 to 10 parts by weight of diluted aqueous acid, for instance 1.5–2% HCl or 3 to 6% aqueous $H_2SO_4$. It is also preferred that the weight ratio water/phenol be above 1 and, adantageously, of the order of 3:2 or 2. As already mentioned for practice of the invention, for each part by weight of the ligno-cellulosic material there are used at least 0.5 part by weight of diluted aqueous acid and at least 0.4 part by weight by phenol or of one of several other phenolic compounds.

For practically carrying out the present invention when using liquid to solid ratios of the order of about 2 to 1 or to 4 to 1 or more, the solid and liquid ingredients, i.e. the vegetal ligno-cellulosic material in comminuted form (wood cuttings, chips, shavings, sawdust, chopped straw or bagasse, etc . . . for instance), the aqueous acid and the phenol or mixture of phenols are charged in a container (glass flask or tube in the laboratory or industrial reactors in a plant) and the mixture is heated for 1 to 8 hrs to the boil. However, more sophisticated industrial equipment can be used also as will be seen hereinafter. In general, 2–4 hrs of heating are enough which is one further advantage of the invention relative to the prior-art in which the heating periods (under pressure) are much longer. Once the heating period is discontinued, the residual solid is filtered and drained, which is constituted by very pure cellulose (K being of the order of 30 to 100), with a yield of approximately 80–90% relative to theory (a 100% yield refers to the theoretical total amount of cellulose present in the sample), and it is washed with some warm water, possibly made alkaline with NaOH or KOH, and/or a water compatible solvent (e.g. acetone or methanol) for removing all the phenol remnants trapped therein. Then, the liquid phase (diluted acid plus the starting phenol plus the phenol-lignin just produced by the sample delignification) may be taken taken again and recycled with a fresh portion of wooden dust. This cycle can be repeated at least four times, the delignification efficiency and the purity of the obtained cellulose decreasing only slowly.

After a number of cycles, the aqueous phase loaded with pentoses is separated from the ligno-phenolic phase by simple decantation. The pentoses are then extracted from the aqueous solution by usual means or, if desired, the solution can be directly heat-treated for converting the pentoses into furane derivatives. This aqueous solution can also be subjected to fermentation (preparation of the proteins, alcohol, etc . . . ), the phenol dissolved in this aqueous phase being removed beforehand (for instance, by extraction and distillation).

In regard to the organic phase, the latter is first distilled which enables to recover an important quantity of pure phenol and a mixture of the phenols issued from the lignin; then the undistillable residue is pyrolyzed which provides further phenols and a porous carbonaceous residue usable as a fuel or as adsorbent carbon as well as volatile substances (gases) which can also be burned.

It should be added that at the end of the delignification of a charge of ligno-cellulosic material, it is possible, after separating by cooling and decanting the phenol phase from the water phase, to recontact the latter after heating with the drained delignified pulp so as to amplify the extraction therefrom of the remaining phenolic substances still adsorbed thereon. After such further hot "rinsing" of the delignified cellulose by means of the aqueous phase, the latter is observed to reform, after cooling, a new phenol containing organic layer that can be again separated by decantation. Such a "rinsing" operation can still be repeated once or more if desired. It is thus possible by this expedient to further decrease the total amount of solvent (or alkaline water) used for washing the cellulose at the end of the reaction and, for this reason, increase the degree of recovery of the phenols from the aqueous phase.

The technical variations just described hereinabove are primarily applicable, as already said, when in the present method the ratio of liquid to solid exceeds a certain value (in the approximate range of 2:1 to about 4:1) above which the solid is easily dispersible in the liquid and, after the reaction is completed, the liquid can be easily drained from the solid by usual means, e.g. filtration under suction or filter presses. In cases where this ratio liquid to solid is below said value (actually this value is not a strickly defined limit since it may naturally vary depending on the nature of the ligno-cellulosic material, the comminuting techniques and the size and surface state of the particles), i.e. when the quantity of liquid relative to that of the solid is below the level at which the solid can be freely dispersed in the liquid and when said liquid is rather in the "adsorbed state" within the solid particulate material, other handling techniques are preferably used. Thus, in such cases, the dry comminuted solid, the aqueous acid and the phenol or phenols are initially thoroughly mixed or kneaded together by any classical means, for instance a slow rotating agitator, a kneader or the like and the kneaded mix is introduced in a container in which the heating operation can be undertaken. Such container can be a closed tube or a reactor. On the industrial scale, a screw-type feed device connected to a vertical tubular reactor is conveniently used. The solid comminuted material is introduced in the hopper of the feed screw and the liquids are injected side wise in the feed screw duct whereby efficient mixing during conveying of the materials to the reactor is obtained. Then the material is progressively packed continuously in the reactor from the top thereof and the mixture therein is subjected to heating for the required overall time i.e. from about ½ to 2 hrs in all, whereby contraction (by hydrolysis and delignification) and partial fluidization occur and the pasty viscous product accumulates at the bottom of the reactor wherefrom it is removed by other classical means, e.g. another screw conveyor.

At the outset of the reactor, the pasty mass is subjected to treatments for physically separating the components of the ligno-cellulosic material (i.e. the cellulose, the sugar monomers and the phenolic compounds) which are still mixed together but potentially split from each other (in the chemical sense) by the above process. Such treatments involve washing steps quite alike the aforesaid disclosed rinsing steps of the drained delignified cellulose crops. Thus, the pasty mass can be taken with a suitable aqueous solvent that will entrain the liquid or water entrainable component of the mixture and effect separation from the solid delignified cellulose. Such a solvent is conveniently warm phenol-saturated water. Indeed, if the mass is taken with such a solvent and the whole is drained on a filter for instance, the phenolic phase, the acid and the hydrolyzed pentoses will be removed in the liquid phase that will ultimately separate into the expected organic (phenol) and water phases (sugar solution) which can be then decanted and further processed separately as described previously. Of course, in the aforesaid mentioned cases where the liquid to solid ratio is on the low side, saturation of the phenol solvent with the phenol lignin will occur guite soon (normally already after one cycle) and recycling of the phenol plus phenol-lignin needs not be contemplated. Thus, such cases rather refer to a continuous process in which the material to be treated is fed continuously to the delignification equipment together with the other required reagents and the products are directly gathered and subjected to further purification treatments.

Summarizing briefly, the present method has the following advantages relative to the teaching of the prior-art:

(a) Moderate reaction temperature that enables to operate with untightly sealed reactors, i.e. containers operating under atmospheric pressure or in conditions only slightly above or below ambient pressure.

(b) Excellent efficiency for dissolving pentosans in the aqueous phase (yields can attain 98%) and the ready possibility of recovering and further using the resulting pentoses.

(c) Minimized formation of reaction products between phenol and dissolved lignin and also minimum degradation of the pentoses at the temperatures considered and, consequently, minimal formation of resins from the phenols reacting with said degradation products, whereby said phenols can be easily recovered and an excess of such phenols relative to the initial added quantity is even recoverable.

(d) Easy separation of the three key phases involved in the method: solid phase, i.e. cellulose of a high degree of purity; aqueous phase with a high concentration of pentoses; and organic ligno-phenolic phase the distillation and further pyrolysis of which provides a considerable quantity of useful products.

(e) Full profitability from the wood constituents, losses being kept to a minimum. With classical methods, the pentoses, lignin and part of the phenol are lost or decomposed to a much larger extent.

(f) High cellulose quality and excellent purification yields.

(g) Independence of the method relative to the starting reagents. After the initial addition of phenol, the operations can be continued with the recovered phenols without the need of additional external phenols. Further, energywise, the use of the recovered carbonaceous residue and the volatile gases gives autonomy to the method which does not comprise evaporating steps or the concentration of large volumes of water.

(h) In the case where relatively high liquid to solid ratios are used, repeated recycling of the liquid phase for the successive delignification of several portions of ligno-cellulosic materials will provide, after several cycles, an aqueous phase the sugar concentration of which is very high.

(i) The unpyrolyzed lignin can be used directly as a fuel (little polluting because it is free from sulfur and minerals except for a small amount of ashes), as a source of phenols or as starting material for making polymeric resins.

(j) Possibility of using a large variety of ligno-cellulosic wastes (wood, hardwoods and softwoods, grassy products, leaves, pulping wastes, bagasse, straws, barks, etc . . . ) in the green or in the dry state, the water needed for reaction being easily adapted depending on the moisture already present in the starting material. Thus, for instance, sugarcane stalks freshly extracted (green bagasse) can be used as well as dry stalks (dry bagasse), the amount of water in the reactor being larger in the second case than in the first.

The following Examples illustrate the invention in more detail.

EXAMPLE 1

In a 250 ml pyrex flask provided with a reflux condenser, there were charged the following ingredients: 10 g of beech-wood sawdust with 10% moisture (composition: 17.25% of pentosanes, 53.6% of cellulose, 27.4% of lignin and 1.2% of ashes), 40 g of phenol and 60 ml of 1.85% HCl (pH 0.3). The mixture was refluxed for 4 hrs after which the solid was drained on a Büchner funnel and washed with warm water and acetone. Yield 4 g, 78%; K (Kappa)=40; lignin content=6% (Analysis by the Standard method TAPPI T-122 OS-74).

After cooling, the liquid phase resulting from the filtration of the cellulose split into two phases which were separated by decantation in a separatory funnel. The upper aqueous phase was analyzed according to LISOV & YAROTSKII (Izvest. Akad. Nauk SSSR, Ser. Khim (4), 877–88 (1974) and was shown to contain 1.47 g of pentoses (85% of theory) and 0.43 g of hexose (8% of theoretical glucose) together with a small quantity of dissolved phenol. The organic phase (42 g) contained the main part of the delignification phenol and, dissolved therein, the phenol-lignin resulting from delignification of the wood. Significant amounts of phenol were also recovered from the washings of the cellulose.

EXAMPLE 2

In a 2 l flask fitted as described in Example 1, there were placed 100 g of beech-wood sawdust (see composition in Example 1), 400 g of phenol and 600 ml of 1.85% aqueous HCl. After boiling for 4 hrs, the solid was drained on a Büchner funnel and washed with warm 1.85% HCl until having a total filtrate of 1000 g. An aliquot of this liquid was taken for analysis after which the liquid was recycled for delignifying a fresh portion of 100 g of sawdust. Thereafter, the same full cycle was repeated two more times each with a new portion of 100 g of sawdust and the filtrate from the previous cycle. Each time, an aliquot of the liquid was taken for analysis. The results are gathered in Table I below together with the results of analysis of the obtained cellulose fractions.

TABLE I

| | Obtained cellulose fibers | | | Yield of sugar monomers | |
|---|---|---|---|---|---|
| Cycle No. | Weight (g) | Lignin (%) | K number | Pentoses (C 5%) | Hexoses (C 6%) |
| 1 | 45.7 | 6.9 | 46 | 80.7 | 8.2 |
| 2 | 47.1 | 7.25 | 48.3 | 82.5 | 7.2 |
| 3 | 49.1 | 9.85 | 65.7 | 82 | 5.8 |
| 4 | 54.5 | 18.2 | 121.3 | 100 | 2.4 |

After the fourth cycle, the liquid was separated as in Example 1 into an aqueous phase and an organic phase. The aqueous phase was first counter-current extracted with toluene and the toluene extract was added, after removal of the solvent, to the organic phase. The purified aqueous phase contained, dissolved, about 60 g of pentoses. This fraction was steam distilled whereby the furfural (produced by heat from the pentoses) was separated.

The combined organic phase (about 490 g) was distilled (73°/13 Torr) which provided 323 g of phenol (about 67%), the undistillable residue was, as shown by NMR analysis, a mixture of phenols derived from wood and partially degraded lignin. This residue was pyrolyzed under nitrogen at 450° C. which provided 111.6 g (68% of the residue) of an anhydrous mixture of ordinary phenol (62.4%) and other phenolic compounds (37.6%) which were subjected to vapor phase chromatography (see SCHWEERS & RECHY, PAPIER 26 (10a), 585 (1972)). This enabled to identify some typical phenols resulting from the degradation of wood, i.e. guaiacol, the cresols, etc. The residue from pyrolysis (51.3 g, 30.7%) consisted in a porous carbonaceous residue (plus ashes) and the difference in weight from theory was due to the evolution of non condensable volatile gases.

EXAMPLE 3

The same procedure as in the previous Examples was followed by using 5 g of sawdust, 30 ml of aqueous 1.85% HCl and 20 g of the phenol mixture as obtained after pyrolysis in Example 2. There was thus obtained 2 g of cellulose K=33; lignin content 5%. The aqueous phase contained 98.6% of the theoretical amount of pentoses (calculated on the hemicellulose content of the sawdust used), 9% of hexoses and 1 g of phenol. The organic phase (21 g) gave 8.3 of phenol by distillation.

For comparison purposes a test was undertaken by subjecting 10 g of sawdust to 4 hrs of cooking with 100 ml of 1.85% aqueous HCl without phenol. In this case, the yield in pentoses was only about 70%. This shows, and this is there an unexpected and surprising effect of the invention, that the phenols promote the hydrolysis of the hemicellulose component of ligno-cellulosic substances simultaneously with the delignification thereof.

EXAMPLE 4

In a 500 ml flask provided with a condenser and a stirrer, there were introduced 100 g of the mixture of phenols, such as that obtained by pyrolysis according to Example 2, and 123 g of formaldehyde as the standard 37% aqueous solution. There were still added 4.7 g of $Ba(OH)_2.8H_2O$ and the mixture was agitated for 2 hrs at 70° C. The mixture was neutralized to pH 6–7 with 10% $H_2SO_4$ and it was concentrated under reduced pressure below 70° C. until a viscous mass was obtained. This mass constitutes a "stage A" prehardened "RESOL" type resin. It can be used for instance for the manufacture of laminated panels, as an adhesive for agglomerated wood panels and for thermosetting coating compositions according to usual means.

EXAMPLE 5

Investigation of operational parameters

With the objective of better knowing the importance of operational parameters such as temperature, reaction time, acid strength, phenol to solid ratio, etc., a series of delignification experiments were carried out with samples of 30 g (1 part) of dry bagasse (average composition: cellulose 40.2%; hemicellulose 25.6%; lignin 22.2%; extractibles 7.24%; ashes 4.76%) which were treated with various mixtures of phenol and acidified water at various temperatures and for various lengths of time. Then, the delignified pulp was separated by filtration and it was extracted with 5% sodium hydroxide solution in order to remove all the adsorbed phenol in the form of alkali phenolate (the solution of phenolate was thereafter acidified in order to cause the phenol to separate and this second crop of phenol was added to the first crop from the above filtration). Moreover, in addition to the weighing of the purified pulp and the analysis of the residual lignin content therein, the amounts of $C_5$ sugars (pentoses) and $C_6$ sugars (hexoses) were determined in the aqueous reaction phase.

The analytical methods used were as follows: For the phenol in water, conversion into tribromophenol by bromine at pH around 0 to 1 was used followed by back titration of the excess of bromine with KI+thiosulfate. According to another route, a VPC analysis was carried out (column DC 550, silicone oil; temperature of column: 147° C.; temperature of injector: 190° C.; carrier gas: nitrogen at 60 ml/min; detector: by flame ionization. There was also used a HPLC analysis method (High Performance liquid Chromatograhy) (column C-18 RP-WATERS-Bondapack 10μ; solvent acetone/-water 40/60 at 1 ml/min; detection at $\lambda=254$ mμ; internal standard: acetophenone).

The sugars resulting from hydrolysis were analyzed in the aqueous phase and in the pulp washing water fractions by the o-toluidine method. The total of these sugar values is recorded in the yield figures of the Tables below.

The operating parameters used for the above described operations and the obtained results are summarized in Tables II to IV hereinafter.

In the Tables, the heading "separated solids" concerns the total weight of isolated pulp, plus the undissolved lignin, plus the ashes, plus other insoluble impurities. The weight % of lignin in said solids (pulp) is give in the next column. The data concerning the sugars liberated by hydrolysis are given in % relative to the theoretical amount of said sugars derived from the total original content of the sample in cellulose and hemicellulose.

TABLE II (Effect of reaction time at various reacting temperatures for the reaction of 1 part of bagasse, 4 parts of phenol and 6 parts of aqueous HCl at 1.85% by weight)

| Experiment No. | Temp. °C. | Reaction Time (hrs) | Separated Solids (ppw) | Residual lignin in pulp (%) | Recovered pentoses (%) | Recovered hexoses (%) |
|---|---|---|---|---|---|---|
| B-14 | 90 | 1 | 0.59 | 11.4 | 68 | 10 |
| B-12 | 90 | 2 | 0.42 | 10 | 84.3 | — |
| B-13 | 90 | 3 | 0.52 | 7.14 | 91 | 3 |
| B-7 | 90 | 4 | 0.52 | 5.5 | 85 | — |
| B-9 | 100 | 1 | 0.44 | 6.4 | 85 | 17 |
| B-10 | 100 | 2 | 0.45 | 4.4 | 89 | 13 |
| B-11 | 100 | 3 | 0.43 | 4.1 | 91 | 16 |
| B-8 | 100 | 4 | 0.43 | 3 | 95 | 11 |

The data of the above TABLE II show that the general trend with increasing reaction time is to improve the dissolution of lignin and the hydrolysis of the pentosanes. There is not much change in the amount of dissolved $C_6$ sugars. Operating at 100° C. gives better results than at 90° C.

TABLE III (The effect of changing the amount of phenol relative to the aqueous acid (1.85% for 1 part of bagasse reacted for 4 hrs at 100° C.))

| Experiment No. | Acidic solution (ppw) | Phenol (ppw) | Separated solids (ppw) | Lignin in pulp (%) | Recovered pentoses (%) | Recovered hexoses (%) |
|---|---|---|---|---|---|---|
| B-19 | 8 | 2 | 0.44 | 5.1 | 91 | 12 |
| B-18 | 7 | 3 | 0.42 | 4 | 93 | 16 |
| B-8 | 6 | 4 | 0.435 | 3 | 95 | 11 |
| B-20 | 5 | 5 | 0.42 | 3.6 | 93 | 16 |

TABLE III-continued (The effect of changing the amount of phenol relative to the aqueous acid (1.85% for 1 part of bagasse reacted for 4 hrs at 100° C.))

| Experiment No. | Acidic solution (ppw) | Phenol (ppw) | Separated solids (ppw) | Lignin in pulp (%) | Recovered pentoses (%) | Recovered hexoses (%) |
|---|---|---|---|---|---|---|
| B-8''' | 9 | 6 | 0.41 | 3 | 95 | 16 |

The data of TABLE III show that, except for a slight improvement in the amount of lignin contaminating the separated pulp, the decrease in the total of phenol used for delignification has not much influence.

TABLE IV (The effect of changing the acid concentration of the water phase in the case of reacting 1 part of bagasse with 4 parts of phenol and 6 part of aqueous solution at 100° for 4 hrs).

| Experiment No. | HCL conc. (%) | Separated solids (ppw) | Lignin in pulp (%) | Recovered pentoses (%) | Recovered hexoses (%) | Recovered phenols (%) |
|---|---|---|---|---|---|---|
| B-23 | 0.01 | 0.91 | 13.2 | 16.6 | 4.2 | — |
| B-21 | 0.5 | 0.50 | 7.6 | 83.3 | 12.5 | — |
| B-22 | 1.0 | 0.433 | 7.9 | 83.7 | — | — |
| B-8 | 1.85 | 0.435 | 3 | 95 | 11 | 99.13% |
| B-36 | 10.0 | 0.34 | 2.22 | 6 | 16 | 96.25% |

The data of TABLE IV show that low concentration of acid such as disclosed by HARTMUTH (DE-C—326.705) are totally unsuitable for achieving the invention in the prevailing conditions, i.e. reflux at ordinary pressure. Too much acid is also detrimental, both for pentoses and phenol recovery.

EXAMPLE 6

This Example will be better understood with reference to the annexed drawing which has been described earlier.

Employing the equipment, illustrated in the drawing, further details for this present Example are: 67 g of bagasse containing 10% $H_2O$ (i.e. 60.3 g dry bagasse) were packed in the reactor 1 with the double-envelope 10 having an internal diameter of 40 mm and a length of 370 mm. The top of the column was connected to the condenser 8 cooled with water. The bottom of the column was connected to the thermostated tank 4 which contained the required amount of aqueous phenol mixture for the delignification operation, i.e. 400 g of phenol (purity: 99.5%) and 600 ml of 1.85% HCl solution. The aqueous phenol phase was heated to near 100° C. by means of the circulating oil; at this temperature it provided a homogeneous solution, i.e. the phenol was entirely dissolved in the water. This phase was pumped using the teflon recirculating pump 7. The liquid flow was regulated in order to maintain a correct level of liquid above the bagasse fixed bed using the by-pass valve 14 and this was also for homogeneizing the circulating liquid phase in the circuit. The liquid circulation was maintained for 3 hours after equilibration of the temperature of the liquid to 100° C. In the fixed bagasse bed a slight boiling of liquid was maintained by raising the temperature of the thermostating oil to about 120° C. After reaction completion, the pump was stopped and the liquid was drained off by gravity during cooling. The liquid solution was collected and cooled in flask 4. The organic layer (main organic phase) was then separated from the aqueous layer by decantation.

The aqueous phase, after separation of the first crop of organics, was heated again and recirculated for 3 hours at 100° C. through the fixed bagasse pulp bed. During this treatment some additional phenol retained previously in the pulp fibres was removed. This liquid phase (main aqueous phase) was again cooled to room temperature which caused the separation of another organic layer (second crop of phenol). This phenol was decanted and added to the main organic phase. The cellulose in reactor 1 was then washed as follows:

1st washing 500 ml of clean water was then added to the circuit heated to 100° C. and circulated through the pulp fixed bed for 2.5 hours. Then, after cooling the pulp was drained under slightly reduced pressure and the washing water was recovered for phenol analysis.

2nd washing (with alkali)

500 ml of water containing 10 g of sodium hydroxide was introduced into the circuit and circulated through the pulp bed for 2 hours at 40° C. (maximum). Then the pulp was again drained under reduced pressure. The washing with alkali was then acidified to pH 5 with hydrochloric acid. The second washing was then analysed for its phenol content.

3rd washing (with acidified water)

The pulp was removed from reactor 1 and placed on a büchner funnel and washed with about 2 liters (in small fractions) of acidified water (pH 4) to remove the residual alkalinity. After centrifugation in a basket, the final pulp had a 50–60% residual $H_2O$ content. The cellulose yield in the pulp was determined after the drying of an aliquot. 29 g of pulped bagasse were recovered.

In the reaction there were used 67 g of bagasse (60.3 g dry), plus 400 g of phenol, plus 600 ml of 1.85% aqueous HCl. Total is approximately 1067 g.

There were recovered, after the reaction and before the recirculation, 472 g of main aqueous phase, 294.5 g of main organic phase and about 300 g of wet pulp the total of which is approximately the same as above. After the three hours of recirculation, reextraction of the pulp and completion of the organic phase, the respective weight had become: main aqueous phase: 377.5 g (analysis, 7.2% phenol=27.2 g of phenol); main organic phase: 424 g (analysis, 71.6% =303.94 g of phenol); first washing water: 466.3 g (analysis, 7.45% =34.74 g of phenol); second alkaline washing: 611 g (analysis, 4.65% =28.4 g of phenol); third washing: 2006 g (analysis, phenol content not significant). Thus the total of phenol in the various fractions was 393 g which accounts for nearly all of the phenol at the start.

The recovered pulp (29 g=48% of the dry bagasse) had a K number of 13 which corresponds to 2.7% of residual lignin. Aliquots of this pulp were hydrolyzed with 40% HCl and analysis of the diluted solutions indicated that the sample contained 78.75% of cellulose (ascertained by the $C_6$ sugars content) and 3.5% of hemi-cellulose (from the $C_5$ content). The difference of 17.75% was due to the residual lignin, the ashes and other insoluble components.

One hundred gram of the organic phase (containing, in principle 28.3 g of material other than free phenol) were distilled under reduced pressure which gave about 97 g of moist phenols plus a residue of 3 g of moist lignin. After drying this lignin residue, it was calculated (with reference to the total organic phase) that the total lignin in the organic phase was 10.6 g.

EXAMPLE 7

Wood delignification with oxalic acid as catalyst instead of HCl

There were used:

20 g dry birch sawdust (22.2 g wet), 80 g of phenol, 100 ml of an aqueous oxalic acid solution of 0.5N (22.5 g/l or 2.25 g/dl, 100 ml $H_2O$). Heating was carried out 4.5 hours at 100° C.

After cooling and filtration of the liquid the pulp was washed on the filter with several portions of hot water. The total aqueous phase recovered was 2 liters. The organic phase was 0.055 l. The yield of sugar monomers recovered in the liquid was:

Pentoses ($C_5$%): 31.55%, Hexoses ($C_6$%): 15.12%.

The washed pulp after drying weighed 15.5 g. The K number of this pulp was 87.45 corresponding to a residual lignin content of 13.11% (2.03 g). The initial lignin present in the raw material was 4 g, therefore 50% of the lignin had been dissolved.

EXAMPLE 8

Twenty grams of dry bagasse were refluxed 4 hrs at 100° C. with 80 g of vanillin and 120 g of 1.85% aqueous HCl. The mass was hot filtered on a Büchner funnel and washed with 600 ml of hot water (by portion) and 200 ml of 1% aqueous NaOH, then again with water to neutrality. The yield of delignified pulp was 8.9 g (dry); K=20 (3% lignin). The combined liquid phases were allowed to stand, after which the organic phase was separated from the water phase and distilled upon which the vanillin was recovered. The aqueous phase contained 92% of the theoretical pentoses and 12% of hexoses (from hydrolysis of the cellulose).

EXAMPLE 9

The procedure of Example 8 was repeated but using 100 g of a 1:1:1 mixture of the o-,p- and m-cresols and 150 ml of 1.85% HCl. After washing as above, the water phase gave 96% of $C_5$ sugars and 15% of $C_6$ sugars whereas the cresols were recovered by distillation of the organic phase. Pyrolysis of the residue gave a further crop of wood phenols. The yield of dry pulp was 8.1 g; K=18.7 (2.8% lignin).

EXAMPLE 10

Sixty grams of comminuted bagasse (weight calculated on the basis of dehydrated material), 84 g of phenol and 126 g of 1.85% aqueous HCl were kneaded together until full impregnation was achieved. Then the moist material was divided into 4 lots and each lot was introduced into a 100 ml glass tube which was closed with a stopper. The tubes were heated for periods of times (shown below) without agitation, then they were cooled and the reacted product was treated as described in the previous Examples for separating the constituents. The results concerning the yield of delignified cellulose and the residual lignin of said cellulose are shown in TABLE V. The Experiments were actually carried out twice, the results shown being the average of the two experiments.

TABLE V

| Sample | Heating time (hrs) | Pulp yield (%) | Residual lignin in pulp after NaOH washing (%) |
|---|---|---|---|
| 1 | 1 | 40.5 | 4.18 |
| 2 | 2 | 40.5 | 4.4 |
| 3 | 3 | 40 | 3.5 |
| 4 | 4 | 41 | 3.5 |

The above results show that prolonged heating time do not bring much significant improvements.

EXAMPLE 11

One hundred and eleven grams of dry bagasse (i.e. 100 g of completely dehydrated material) were placed in a horizontally rotating flask equipped with a reflux condenser (ROTAVAPOR) and 160 g of phenol and 240 g of 1.85% aqueous HCl were added. The flask was rotated for 30 minutes at room temperature to ensure proper mixing of the ingredients after which rotation was continued under heating to reflux temperature (bath at 105° C.) for periods of times. After cooling, the mixture was treated as usual and gave the results shown in TABLE VI.

TABLE VI

| Sample | Reaction time (hrs) | pulp yield (%) | Residual lignin in pulp (%) | Yield of sugars (%) | |
|---|---|---|---|---|---|
| | | | | pentoses | hexoses |
| 1 | 1 | 40 | 4.86 | 85 | 16 |
| 2 | 2 | 39 | 4.80 | 81 | 21 |
| 3 | 3 | 41 | 4.89 | 85 | 16 |
| 4 | 4 | 43 | 3.99 | 74 | 16 |

EXAMPLE 12

Experiments similar to those of Example 10 were carried out using 42.5 g birch shavings (38.25 g anhydrous), 53.55 g of phenol and 80.32 g of 1.85% aqueous HCl. Four samples were subjected to heating periods and the products were separated and analyzed as usual. The results are shown in TABLE VII.

TABLE VII

| Sample | Heating time (hrs) | Pulp yield (%) | Residual lignin in pulp (%) | Yield of sugars (%) | |
|---|---|---|---|---|---|
| | | | | pentoses | hexoses |
| 1 | 1.75 | 42 | 7.14 | 65 | 20 |
| 2 | 1.75 | 42 | 7.56 | 53 | 70 |
| 3 | 2.75 | 41.6 | 4.76 | 91 | 33 |
| 4 | 2.75 | 41.7 | 4.66 | 64 | 12 |

The reason why the reproducibility of the results regarding the liberation of the sugars is not good has not been investigated.

EXAMPLE 13

Experiments identical with those reported in Example 11 were carried out using four 110 g lots of birchwood chips with either the addition of 80 g of phenol plus 120 g of 1.85% HCl (sample A) or the addition of 160 g of phenol plus 240 g of 1.85% HCl (sample B). Heating periods were 2 and 4 hrs. Preheating time to refluxing temperature (i.e. to zero time regarding the boiling periods) was 20 min. After cooling the reaction mixture, it was successively washed with hot water, warm dilute aqueous NaOH solution and water again. The results are gathered in TABLE VIII.

TABLE VIII

| Sample | Heating time (hrs) | Pulp yield (%) | Residual lignin in pulp (%) | Yield of sugars (%) | |
|---|---|---|---|---|---|
| | | | | pentoses | hexoses |
| A-1 | 2 | 44 | 7.1 | 77 | 6.8 |
| A-2 | 4 | 39 | 4.2 | 82 | 5.8 |
| B-1 | 2 | 40 | 5.6 | 78 | 11.4 |
| B-2 | 4 | 37 | 1.9 | 90 | 12 |

These results do not show significant differences except with regard to the amount of cellulose converted to hexoses which is higher when using larger proportions of phenol+acid.

EXAMPLE 14

A mixture of 111 g of chopped bagasse (100 g on a fully dry basis), 160 g of phenol and 240 g of a 1N sulfuric acid solution (4.625% by weight) was rotated in a rotating evaporator under reflux for one hour. The reaction mixture was put on a filter and drained thus providing a liquid which decanted to two phases (organic, 80 ml and aqueous, 75 ml). Then the pulp on the filter was washed with several portions of hot water then with 1N NaOH solution. The hot water washing portions were added to the 75 ml of aqueous phase already separated. The remaining solid was dried and weighed 42.9 g.

Pentose, hexose and lignin analysis were carried out on the various components and the following results were obtained: (distribution of the sugars in percent of their theoretical amount in the starting bagasse)

| | |
|---|---|
| Combined aqueous fractions: | $C_5$, 60%; $C_6$, 9%; lignin: — |
| Organic phase: | $C_5$, 20%; $C_6$, 1%; lignin: 88% |
| Dried pulp: | $C_5$, 20%; $C_6$, 90%; lignin: 12% |

The 80 ml of the organic phase were boiled for one hour with 80 ml of the combined washing phase and after cooling and separation of the phases, it was found by analysis that 80% of the sugars originally retained in the organic phase had been extracted and had passed into the aqueous solution. Thus, the overall yield of pentoses (dissolved in the water phase) was 76%. The other analytical results showed that 88% of the lignin originally contained in the sample had been dissolved, the residual lignin content of the pulp being 6.3%.

We claim:

1. A method for simultaneous delignification of wood and other ligno-cellulosic materials and hydrolysis of the hemicellulose component thereof into monomeric sugars and recovering pulp, phenol, lignin and sugars, which comprises:

(a) contacting one part by weight solids of said wood or other lignocellulosic materials with a liquid of at least 0.5 to 100 parts by weight of a dilute aqueous acid of a pH below 1.5 and having an acid concentration of 0.5 to 6.0% by weight, and 0.4 to 6.0 parts by weight of phenol or other phenolic compounds;

(b) heating the contacting solids, aqueous acid and phenol or other phenolic compounds under ambient pressure or slightly above or below ambient pressure and only at reflux temperatures of from 90° to 110° C. for ½ to 8 hours to form a delignified and hydrolysed pulp;

(c) filtering and draining the pulp of step (b) without further heating to provide a filtrate and a residual solid of said pulp; and (d) separating of the filtrate into an organic phase containing said phenol and lignin and an aqueous phase containing said sugars.

2. The method of claim 1, wherein the acid is selected from the group consisting of HCl, $H_2SO_4$, oxalic acid, benzene-sulfonic acid, trichloracetic acid, other alkyl and arylsulfonic acids and mixtures of said acids.

3. The method of claim 2 employing aqueous hydrochloric acid of a concentration of 1 to 3% by weight.

4. The method of claim 2 employing aqueous $H_2SO_4$ of a concentration of 3 to 6% by weight.

5. The method of claim 1 employing a mixture of phenols provided by a pyrolytic distillation of a lignin fraction from said delignification.

6. The method of claim 1 employing for the other phenolic compounds those which comprise phenol-lignin produced from said delignification, and in admixture with hydroxybenzene or phenols or both provided by a pyrolytic distillation of a lignin fraction from said delignification.

7. The method of claim 1 including said heating for 1 to 8 hours.

8. The method of claim 1 employing for the contacting of a ratio of the liquids to the solids higher than a range of about 2:1 to 4:1 and with the pulp from the filtering and draining containing delignified cellulose, and with the aqueous phase from the separating containing pentoses, and with the organic phase from the separating containing phenol-lignin.

9. The method of claim 8 which further includes a separating of pentoses from the aqueous phase by concentration, crystallization and isolation or by heating to convert them into furfural and with isolation of the furfural.

10. The method of claim 8 which further includes a distilling of the organic phase to provide a distillate and a residue and pyrolyzing of the residue to provide phenolic compounds, a combustible carbonaceous residue, and combustible gases.

11. The method of claim 8 in which there is a first practicing of the method which is followed by a second practicing thereof using for the other phenolic compounds said organic phase resulting from the first practicing.

12. The method of claim 8 including said heating of for ½ to 2 hours.

13. The method of claim 1 in which there is a first practicing of the method which is followed by a second practicing using for the liquids the filtrate from the filtering and draining in the first practicing.

14. The method of claim 8 employing for the contacting of a ratio by weight of the liquids to the solids below the range of about 2:1 to 4:1, and which includes adding additional aqueous liquid to aid said filtration and draining.

15. The method of claim 14 employing warm water saturated with phenol for said additional aqueous liquid.

16. A method for simultaneous delignification of wood and other lingo-cellulosic materials and hydrolysis of the hemicellulose component thereof into monomeric sugars in which said wood and other lingo-cellulosic materials are heated with acidic aqueous phenol or other phenolic compounds and with ultimately separating a delignified cellulose from said aqueous acidic phenol, which comprises:

(a) contacting one part by weight solids of said wood or other lignocellulosic materials with a liquid of at least 1.0 to 10.0 parts by weight of a dilute aqueous acid of a pH below 1.5 and having an acid concentration of 0.5 to 6.0% by weight, and 0.4 to 6.0 parts by weight of phenol or other phenolic compounds;

(b) heating the aqueous mixture under ambient pressure or slightly above or below ambient pressure and only at reflux temperatures of from 90° to 110° C. for 1 to 8 hours to form a delignified and hydrolysed pulp;

(c) filtering and draining the pulp of step (b) without further heating to provide a residual solid and a liquid filtrate;

(d) washing the residual solid with warm water made alkaline by NaOH or KOH and recovering a wash liquid; and (e) combining the liquid filtrate and wash liquid and separating by decantation an organic phase containing said phenol and lignin from an aqueous phase containing said sugars.

* * * * *